US010927469B2

(12) United States Patent
Nunomura et al.

(10) Patent No.: US 10,927,469 B2
(45) Date of Patent: Feb. 23, 2021

(54) PRODUCTION METHOD OF ALUMINUM USING HYDRATE

(71) Applicant: UACJ CORPORATION, Tokyo (JP)

(72) Inventors: Junji Nunomura, Tokyo (JP); Yoichi Kojima, Tokyo (JP); Mikito Ueda, Sapporo (JP)

(73) Assignee: UACJ CORPORATION, Tokyo (JP)

( * ) Notice: Subject to any disclaimer, the term of this patent is extended or adjusted under 35 U.S.C. 154(b) by 0 days.

(21) Appl. No.: 16/662,898

(22) Filed: Oct. 24, 2019

(65) Prior Publication Data

US 2020/0131656 A1 Apr. 30, 2020

(30) Foreign Application Priority Data

Oct. 25, 2018 (JP) ..... JP2018-201121

(51) Int. Cl.
*C25D 3/66* (2006.01)
*C25D 3/44* (2006.01)
*C25D 5/44* (2006.01)

(52) U.S. Cl.
CPC ..... *C25D 3/665* (2013.01); *C25D 5/44* (2013.01); *C25D 3/44* (2013.01)

(58) Field of Classification Search
CPC ..... C25D 3/44; C25D 3/665
See application file for complete search history.

(56) References Cited

U.S. PATENT DOCUMENTS 2,755,313 A * 7/1956 Calfee ..... C07C 17/21 570/166
4,904,355 A 2/1990 Takahashi

FOREIGN PATENT DOCUMENTS

JP 1-272790 A 10/1989
WO WO-2012133111 A1 * 10/2012 ..... C23C 28/32
WO WO-2016004189 A1 * 1/2016 ..... H01M 10/054

OTHER PUBLICATIONS

Chiku et al., Aluminum Bis(trifluoromethanesulfonyl)imide as a Chloride-Free Electrolyte for Rechargeable Aluminum Batteries, 164(9) J. of the Electrchem. Society A1841 (Year: 2017).*
Hirano et al., Machine Translation, W.O. Int'l Pub. No. 2012/133111 A1. (Year: 2012).*
Chiku et al., "Aluminum Bis(trifluoromethanesulfonyl)imide as a Chloride-Free Electrolyte for Rechargeable Aluminum Batteries", Journal of the Electrochemical Society, 2017, vol. 164, No. 9, pp. A1841-A1844.

* cited by examiner

*Primary Examiner* — Brian W Cohen
*Assistant Examiner* — Ho-Sung Chung
(74) *Attorney, Agent, or Firm* — Birch, Stewart, Kolasch & Birch, LLP

(57) ABSTRACT

A production method of aluminum including: a step of synthesizing an aluminum compound from a mixture including a halogenated aluminum hydrate and a perfluoroalkylsulfonimide-type or perfluoroalkylsulfonamide-type ionic liquid represented by general formula (1); a step of dissolving the aluminum compound in a nitrile-based organic solvent to prepare an aluminum electrolyte; a step of adding at least one ligand selected from a phosphorus compound and an organic compound having an amide group to the aluminum electrolyte and dehydrating water molecules from a hydrate included in the aluminum electrolyte; and a step of electrodepositing aluminum on a cathode by allowing electricity to pass between an anode and the cathode in the aluminum electrolyte after the dehydrating step.

8 Claims, No Drawings

PRODUCTION METHOD OF ALUMINUM USING HYDRATE

CROSS REFERENCE TO RELATED APPLICATIONS

This application claims the benefit of Japanese Patent Application No. 2018-201121, filed on Oct. 25, 2018, which is hereby incorporated by reference in its entirety.

BACKGROUND

Technical Field

The present disclosure relates to a production method of aluminum using a hydrate and particularly relates to a new production method of aluminum efficiently electrodepositing aluminum from a halogenated aluminum hydrate by an ionic liquid method.

Background

In general, aluminum is produced by refining bauxite into aluminum oxide (alumina) (Bayer process) followed by the Hall-Heroult process including dissolving alumina and carrying out electrolysis. However, since the electrolysis of alumina in the Hall-Heroult process is carried out at an extremely high temperature, an enormous amount of electric power is required for the electrolysis and production costs are high. Therefore, energy saving in production of aluminum is desired.

As a technique for producing aluminum at a low temperature, particularly around room temperature, electroplating using an electrolyte is widely known. However, since aluminum has a normal electrode potential significantly lower than hydrogen, an aqueous solution usually cannot be used as the electrolyte. Therefore, electrodeposition of aluminum by an ionic liquid method using a non-aqueous solution such as a molten salt or an organic solvent as the electrolyte is carried out.

For example, an electroplating method of aluminum using a molten salt bath of anhydrous halogenated aluminum (anhydrous $AlCl_3$, etc.) and a dialkylimidazolium halide is disclosed in Japanese Patent Laid-Open No. 1-272790. In addition, synthesizing aluminum bis(trifluoromethanesulfonyl)imide ($Al(TFSI)_3$) from anhydrous $AlCl_3$ and bis(trifluoromethanesulfonyl)imide (H-TFSI), and a chargeable aluminum battery utilizing an electrolyte including acetonitrile and the synthesized $Al(TFSI)_3$ are disclosed in Masanobu Chiku et al., "Journal of the electrochemical society", 164(9) A1841-1844 (2017).

However, anhydrous $AlCl_3$ used as a raw material is usually produced by reacting aluminum obtained by the Hall-Heroult process with chlorine gas. Therefore, in a method for producing aluminum by an ionic liquid method with anhydrous $AlCl_3$ used as a raw material, production costs are still high and a large amount of energy (electric power) is required.

As an alternative for anhydrous $AlCl_3$, $AlCl_3.6H_2O$ has attracted attention. $AlCl_3.6H_2O$ is a hydrate and able to be produced by reacting aluminum hydroxide obtained as an intermediate product of the Bayer process, a previous step of the Hall-Heroult process, with hydrochloric acid. That is, $AlCl_3.6H_2O$ can be obtained without the Hall-Heroult process consuming an enormous amount of electric power. Therefore, use of $AlCl_3.6H_2O$ as a raw material in an ionic liquid method is expected to enable electrodeposition of aluminum to be carried out with lower energy consumption amount and at a low cost.

However, $AlCl_3.6H_2O$ hardly dissolves in conventional molten salts and non-aqueous solvents such as organic solvents. In addition, even if $AlCl_3.6H_2O$ can be allowed to dissolve, when water molecules originated from a hydrate exist in the electrolyte, aluminum is not electrodeposited, and electrolysis of water preferentially occurs because the normal electrode potential of aluminum is significantly low as described above.

Further, a halogenated aluminum hydrate such as $AlCl_3.6H_2O$ has a structure in which $H_2O$ molecules bond to Al so as to surround Al, and Cl is bonded around the $H_2O$ molecules. On the other hand, since water molecules surrounding Al may hinder electrodeposition, electrodeposition can be carried out more efficiently by removing water molecules from the hydrate as much as possible. However, even if an aluminum compound having water molecules such as a halogenated aluminum hydrate is heated for dehydration of water molecules, bonds between $H_2O$ and Al cannot be cleaved and aluminum oxide is formed. Therefore, development of a technique enabling removal of water molecules originated from a hydrate from an electrolyte and allowing aluminum to be efficiently electrodeposited is desired.

SUMMARY

The present disclosure is related to providing a new production method of aluminum capable of allowing aluminum to be efficiently electrodeposited from a halogenated aluminum hydrate with lower energy consumption and at a lower cost than before by utilizing an ionic liquid method.

An aspect of the present disclosure is a production method of aluminum including:

a step of synthesizing an aluminum compound derived from an aluminum perfluoroalkyl sulfonyl imide or an aluminum perfluoroalkyl sulfonyl amide from a mixture including a halogenated aluminum hydrate and a perfluoroalkylsulfonimide-type or perfluoroalkylsulfonamide-type ionic liquid represented by the following general formula (1):

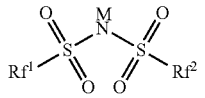

(1)

wherein $Rf^1$ and $Rf^2$ are each independently $CF_3$ or $C_4F_9$, and

M is H, alkali metal, quaternary ammonium or imidazolium;

a step of dissolving the aluminum compound in a nitrile-based organic solvent to prepare an aluminum electrolyte;

a step of adding at least one ligand selected from a phosphorus compound and an organic compound having an amide group to the aluminum electrolyte and dehydrating water molecules from a hydrate included in the aluminum electrolyte; and a step of electrodepositing aluminum on a cathode by allowing electricity to pass between an anode and the cathode in the aluminum electrolyte after the dehydrating step.

An aspect of the present disclosure is a production method of aluminum, wherein the aluminum electrolyte with the at least one ligand added is stirred at 0° C. or higher and 100° C. or lower in the dehydrating step.

An aspect of the present disclosure is a production method of aluminum, wherein constant potential electrolysis with an electrode potential with respect to aluminum used as a reference electrode of −6.0 V or more and less than 0 V or constant current electrolysis with a current density of 1 $\mu Acm^{-2}$ or more and 10000 $\mu Acm^{-2}$ or less is carried out in the electrodepositing step.

An aspect of the present disclosure is a production method of aluminum, wherein a temperature of an electrolytic bath is 20° C. or higher and 100° C. or lower in the electrodepositing step.

An aspect of the present disclosure is a production method of aluminum, wherein $Rf^1$ and $Rf^2$ in the general formula (1) are $CF_3$.

An aspect of the present disclosure is a production method of aluminum, wherein the halogenated aluminum hydrate is aluminum (III) chloride hexahydrate.

An aspect of the present disclosure is a production method of aluminum, wherein the phosphorus compound is selected from the group consisting of phosphonic acid, phosphinic acid, a phosphine oxide, and tributyl phosphate.

An aspect of the present disclosure is a production method of aluminum, wherein the organic compound having an amide group is selected from the group consisting of N-phenylacetamide, dimethylformamide, and dimethylacetamide.

The present disclosure is capable of allowing aluminum to be electrodeposited from a halogenated aluminum hydrate by utilizing an ionic liquid method. Therefore, a new production method of aluminum capable of electrodepositing aluminum with lower energy consumption and at a lower cost than before can be provided. In addition, since water molecules originated from a hydrate which may hinder electrodeposition from an electrolyte are removed, aluminum is allowed to be efficiently electrodeposited.

DETAILED DESCRIPTION

Hereinafter, embodiments of the present disclosure will be described. The present disclosure is not limited to the following embodiments and can be carried out in various aspects within a range not departing from the scope of the present disclosure.

A production method of aluminum according to the present disclosure includes a step of synthesizing an aluminum compound of an aluminum perfluoroalkyl sulfonyl imide or an aluminum perfluoroalkyl sulfonyl amide from a mixture including a halogenated aluminum hydrate and a perfluoroalkylsulfonimide-type or perfluoroalkylsulfonamide-type ionic liquid represented by the following general formula (1):

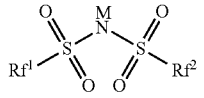

(1)

wherein $Rf^1$ and $R^2$ are each independently $CF_3$ or $C_4F_9$, and

M is H, alkali metal, quaternary ammonium or imidazolium;

a step of dissolving the aluminum compound in a nitrile-based organic solvent to prepare an aluminum electrolyte;

a step of adding at least one ligand selected from a phosphorus compound and an organic compound having an amide group to the aluminum electrolyte and dehydrating water molecules from a hydrate included in the aluminum electrolyte; and a step of electrodepositing aluminum on a cathode by allowing electricity to pass between an anode and the cathode in the aluminum electrolyte after the dehydrating step.

That is, in the production method of aluminum according to the present disclosure, a halogenated aluminum hydrate is used instead of anhydrous halogenated aluminum, the anhydrous halogenated aluminum being an undesirable raw material from a point of view of production costs, energy consumption, etc. Then, a certain aluminum compound is synthesized from the halogenated aluminum hydrate and a predetermined ionic liquid, and the aluminum electrolyte is prepared using an organic solvent capable of dissolving the aluminum compound. Consequently, aluminum is allowed to be electrodeposited at around room temperature by electrolytic reaction with an electrolyte prepared by using the halogenated aluminum hydrate, that is, an ionic liquid method, and therefore aluminum (hereinafter, also simply referred to as "Al") can be produced with lower energy consumption and at a lower cost than before. In addition, water molecules ($H_2O$ ligand) of a hydrate included in the aluminum electrolyte such as a hydrate of the synthesized aluminum compound, an unreacted halogenated aluminum hydrate remaining in the aluminum electrolyte, etc. are replaced by a predetermined ligand by adding the predetermined ligand to the aluminum electrolyte. Consequently, water molecules which may hinder electrodeposition are removed from the hydrate included in the aluminum electrolyte, and therefore aluminum is allowed to be efficiently electrodeposited.

<Synthesis of Aluminum Compound>

First, synthesis of the aluminum compound carried out in the production method of aluminum according to the present disclosure is described. The aluminum compound (hereinafter, also simply referred to as the "Al compound") derived from an aluminum perfluoroalkyl sulfonyl imide or an aluminum perfluoroalkyl sulfonyl amide is synthesized through mixing the predetermined ionic liquid represented by formula (1) and the halogenated aluminum hydrate, and heating the resulting mixture to vaporize moisture and hydrogen chloride, which are byproducts originated from the halogenated aluminum. A mixing ratio of the ionic liquid and the halogenated aluminum hydrate is not particularly limited, and a molar ratio of ionic liquid:halogenated aluminum hydrate is preferably 0.1:1 to 10:1 and more preferably 0.5:1 to 5:1. In addition, a heating temperature of the mixture is also not particularly limited, and the heating temperature is preferably 80° C. or higher and 200° C. or lower and more preferably 100° C. or higher and 150° C. or lower. In addition, distillation may be carried out as necessary to further remove impurities from the heated mixture. A desired Al compound is synthesized through these steps. Such Al compounds are aluminum perfluoroalkyl sulfonyl imides (amides) such as aluminum bis(trifluoromethanesulfonyl)imide and their hydrates, for example.

(Ionic Liquid)

In the present disclosure, an ionic liquid is a general term for liquid ionic compounds (salts) composed of a combination of a cationic species and an anionic species and intends to represent a compound forming a liquid phase at a relatively low temperature not more than 100° C. Such an ionic liquid has quite a low vapor pressure and can be used also in a vacuum like in a SEM in some cases. It is also possible to allow the ionic liquid to exhibit hydrophobicity by appropriately selecting the anionic species.

As the ionic liquid, a compound capable of dissolving in a nitrile-based organic solvent described later and capable of being used as the aluminum electrolyte is selected. Specifically, a perfluoroalkylsulfonimide-type or perfluoroalkylsulfonamide-type ionic liquid represented by the following general formula (1):

(1)

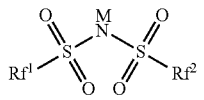

wherein $Rf^1$ and $Rf^2$ are each independently $CF_3$ or $C_4F_9$,

M is H, alkali metal, quaternary ammonium or imidazolium is used. Examples of such an ionic liquid include an ionic liquid based on bis(trifluoromethanesulfonyl)imide in which $Rf^1$ and $Rf^2$ are each $CF_3$ in general formula (1), an ionic liquid based on bis(nonafluorobutanesulfonyl)imide in which $Rf^1$ and $Rf^2$ are each $C_4F_9$, and an ionic liquid based on nonafluoro-N-[(trifluoromethane)sulfonyl]butanesulfonyl amide in which $Rf^1$ is $CF_3$ and $Rf^2$ is $C_4F_9$. Among these ionic liquids, an ionic liquid in which $Rf^1$ and $Rf^2$ are each $CF_3$ in general formula (1), that is, an ionic liquid including an anion of bis(trifluoromethanesulfonyl)imide (hereinafter, also referred to as "TFSI") is preferable, and an ionic liquid in which M as a cation is H, K (potassium), Li (lithium) or Na (sodium), that is, an ionic liquid of HTFSI, KTFSI, LiTFSI or NaTFSI is particularly preferable. For the ionic liquid used in the present disclosure, "imide" means a case where $Rf^1$ and $Rf^2$ have the same structure, and "amide" means a case where $Rf^1$ and $Rf^2$ have different structures with each other.

(Halogenated Aluminum Hydrate)

As a halogenated aluminum hydrate, for example, aluminum (III) fluoride hexahydrate ($AlF_3.6H_2O$), aluminum (III) chloride hexahydrate ($AlCl_3.6H_2O$), aluminum (III) bromide hexahydrate ($AlBr_3.6H_2O$), aluminum (III) iodide hexahydrate ($AlI_3.6H_2O$), etc. can be used. An Al compound synthesized from a mixture of such a halogenated aluminum hydrate and the perfluoroalkyl sulfon imide(amide)-type ionic liquid as described above may be an Al source in an aluminum electrolyte described later. Aluminum (III) chloride hexahydrate is preferable among the halogenated aluminum hydrates from a point of being easily available at a low cost.

<Preparation of Aluminum Electrolyte>

After synthesizing the Al compound, the obtained Al compound is dissolved in a nitrile-based organic solvent to prepare an aluminum electrolyte (hereinafter, simply referred as the "electrolyte"). An amount of the Al compound included in the electrolyte is not particularly limited as long as the Al compound can be sufficiently dissolved in the nitrile-based organic solvent and a sufficient amount of Al can be deposited by electrodeposition described later, and the amount of the Al compound is preferably 0.1 g or more and 100 g or less and more preferably 0.5 g or more and 50 g or less with respect to 100 ml of the electrolyte. In addition, while the Al compound can be dissolved by stirring at ordinary temperature, heating treatment at 40° C. to 80° C., for example, may be carried out to rapidly and surely dissolve the Al compound.

(Organic Solvent)

A nitrile-based compound is used as the organic solvent from points that the Al compound synthesized from the halogenated aluminum hydrate and the above certain perfluoroalkyl sulfon imide(amide)-type ionic liquid can be dissolved in a nitrile-based compound and that a nitrile-based compound is available as a solution of the electrolyte. As such a nitrile-based compound, for example, acetonitrile, acrylonitrile, and benzonitrile are preferable, and acetonitrile is particularly preferable.

<Dehydration of Water Molecules>

After preparing the electrolyte, at least one ligand selected from a phosphorus compound and an organic compound having an amide group is added to the obtained electrolyte to dehydrate water molecules from the hydrate included in the electrolyte. An amount of the ligand added is not particularly limited as long as the ligand is allowed to replace water molecules of the hydrate included in the electrolyte and the ligand do not affect electrodeposition described later in the amount added, and the amount added is preferably 0.01 mol/L or more and 10 mol/L or less and more preferably 0.05 mol/L or more and 5 mol/L or less with respect to 100 ml of the electrolyte. In addition, the ligand to be added may be of one ligand or of two or more ligands.

When water molecules are dehydrated from the hydrate included in the electrolyte, it is preferable that the aluminum electrolyte with at least one ligand added be stirred at 0° C. or higher and 100° C. or lower. In addition, in order to more efficiently conduct subsequent electrodeposition by conducting this dehydration step under a more appropriate condition, a temperature of the aluminum electrolyte including the ligands is more preferably 20° C. or higher and 90° C. or lower and still more preferably 30° C. or higher and 70° C. or lower.

(Ligands)

Ligands are selected from a phosphorus compound and an organic compound having an amide group as a compound capable of replacing water molecules originated from the hydrate included in the electrolyte and dissolving in the nitrile-based organic solvent. Since bonding strength to Al of these compounds is stronger than that of water molecules, these compounds are capable of substituting water molecules existing around Al to form coordinate bonds so as to surround Al. Water molecules of the hydrate included in the electrolyte such as the hydrate of the synthesized Al compound and the unreacted halogenated aluminum hydrate remaining in the electrolyte, for example, are substituted. That is, ligands serve as a dehydrating agent to remove water molecules ($H_2O$ ligands) surrounding Al.

Phosphorus compound is a general term for compounds including a phosphorus atom (P), and examples of the phosphorus compound include a phosphoric acid ester, phosphonic acid, phosphinic acid, a phosphinic acid ester, and a phosphine oxide. The phosphoric acid ester may be any of a monoester, a diester, and a triester, and a phosphoric acid triester is preferable. Examples of the phosphoric acid ester include alkyl phosphates such as trimethyl phosphate, triethyl phosphate, tripropyl phosphate, tributyl phosphate, trioctyl phosphate, (alkyl)aryl phosphates such as triphenyl phosphate, tricresyl phosphate, and trixylenyl phosphate, tributoxyethyl phosphate, and tributyl phosphate is particularly preferable. The phosphonic acid, phosphinic acid, phosphinic acid ester, and a phosphine oxide may be a derivative with at least one H atom bonding to a phosphorus atom having been substituted with an organic group such as an alkyl group, an aryl group, an alkylaryl group or an alkoxy group, for example. Among them, it is preferable that the phosphorus compound be selected from the group consisting of phosphonic acid, phosphinic acid, a phosphine oxide, and tributyl phosphate, and it is particularly preferable that the phosphorus compound be selected from the group consisting of phosphinic acid, a phosphine oxide, and tributyl phosphate.

Examples of the organic compound having an amide group include an aliphatic amide and an aromatic amide. These amides may be any of a primary amide, a secondary amide, and a tertiary amide, and a secondary amide or a tertiary amide is preferable. As the primary amide, formamide, acetamide, propionamide, butyramide, benzamide, etc. are exemplified, for example. As the secondary amide, N-methylformamide, N-ethylformamide, N-methylacetamide, N-ethylacetamide, N-phenylformamide, N-phenylacetamide, etc. are exemplified, for example. As the tertiary amide, dimethylformamide, diethylformamide, dimethylacetamide, diethylacetamide, N,N-dimethylformamide, N,N-diethylformamide, N,N-dimethylacetamide, N,N-diethylformamide, etc. are exemplified, for example. Among them, it is preferable that the organic compound having an amide group be selected from the group consisting of N-phenylacetamide, dimethylformamide, and dimethylacetamide, and it is particularly preferable that the organic compound having an amide group be selected from dimethylformamide and dimethylacetamide.

<Electrodeposition of Aluminum>

After preparing the electrolyte, electricity is allowed to pass between an anode and a cathode in the electrolyte, that is, aluminum is electrodeposited on a cathode by electrolysis. This electrolysis allows Al to be electrodeposited on a surface of the cathode by preparing an electrolytic tank containing an electrolyte, arranging a cathode and an anode to face to each other in the electrolyte, applying a voltage or a current or both of a voltage and a current between both electrodes to allow electricity to pass. On electrodeposition, moisture originated from the halogenated aluminum hydrate may react with electrodeposit to cause electrodeposition of aluminum oxide or hydroxide simultaneously with electrodeposition of Al. However, an amount of these byproducts to be electrodeposited is quite small, and Al is mainly electrodeposited.

(Electrodeposition Conditions)

An electrodeposition temperature, that is, a temperature of the electrolytic bath during electrodeposition is preferably 20° C. or higher and 100° C. or lower, more preferably 20° C. or higher and 80° C. or lower, and still more preferably 30° C. or higher and 70° C. or lower. The lower limit of 20° C. is set as a temperature around room temperature. On the other hand, when the electrodeposition temperature exceeds 100° C., volatilization of the nitrile-based organic solvent in the electrolyte easily occurs and composition of the electrolyte is prone to become unstable. As a result, if electrodeposition failure occurs, Al becomes difficult to be electrodeposited.

Electrodeposition is preferably carried out by constant potential electrolysis with an electrode potential with respect to aluminum used as a reference electrode of −6.0 V or more and less than 0 V or by constant current electrolysis with a current density of 1 $\mu Acm^{-2}$ or more and 10000 $\mu Acm^{-2}$ or less. Constant potential electrolysis is a method for carrying out electrolysis while keeping an electrode potential of one of the anode and the cathode immersed in the electrolyte constant with respect to a reference electrode. In constant potential electrolysis, the electrode potential is preferably set at an electrode potential of −4.0 V or more and less than 0 V and more preferably −2.0 V or more and −0.7 V or less as a potential range lower than 0 V vs. Al/Al(III) where a reduction current is observed with respect to an Al line serving as the reference electrode. An electrode potential of less than −6.0 V results in reduced electrodeposition efficiency because an electrodeposition speed at the electrode potential of less than −6.0 V is too slow, and consequently Al becomes difficult to be electrodeposited. In addition, constant current electrolysis is a method for carrying out electrolysis while keeping a value of current constant. A current density in the constant current electrolysis is preferably 10 $\mu Acm^{-2}$ or more and 10000 $\mu Acm^{-2}$ or less, more preferably 20 $\mu Acm^{-2}$ or more and 1000 $\mu Acm^{-2}$ or less, still more preferably 30 $\mu Acm^{-2}$ or more and 500 $\mu Acm^{-2}$ or less, and particularly preferably 50 $\mu Acm^{-2}$ or more and 300 $\mu Acm^{-2}$ or less. A current density of less than 1 $\mu Acm^{-2}$ results in reduced electrodeposition efficiency because an electrodeposition speed at the current density of less than 1 $\mu Acm^{-2}$ is too slow, and consequently Al becomes difficult to be electrodeposited. On the other hand, when the current density exceeds 10000 $\mu Acm^{-2}$, decomposition in electrolytic bath easily occurs, and consequently Al becomes difficult to be electrodeposited.

(Cathode)

In the production method of aluminum according to the present disclosure, the cathode is not particularly limited. For example, a cathode composed of a metal material such as platinum, gold, and copper may be used to deposit Al on the metal material and the deposited Al may be collected. Alternatively, a cathode composed of a metal material having a passive coating (oxide coating) such as titanium, nickel, and a stainless steel may be used to deposit Al on the passive coating, and the deposited Al may be successively peeled off and collected by utilizing low adhesiveness between the passive coating and Al. In addition, material of the cathode is not limited to metal materials, and a cathode composed of carbon, a plastic material given electrical conductivity, etc. may be used.

(Anode)

In addition, the anode is also not particularly limited, and an aluminum source to be consumed in the electrolyte during electrodeposition can be replenished from the anode with use of soluble aluminum. As an insoluble anode, an electrode of a pure metal such as platinum and titanium, or a titanium electrode coated with an insoluble metal such as platinum, iridium oxide, ruthenium oxide, lead dioxide, etc. can be used.

EXAMPLES

Next, the present disclosure will be described in more detail based on Examples, but the present disclosure is not limited to the Examples.

Examples 1 to 40, Comparative Examples 1 to 8

Aluminum was produced according to the following procedures.

<Synthesis of Al Compound>

Ionic liquids and halogenated aluminum compounds shown in Table 1 were used to be mixed so as to achieve a molar ratio of ionic liquid:halogenated aluminum compound=3:1. Then, the obtained mixtures were heated at 120° C. to prepare aluminum compounds to be desired Al sources.

Synthesis reaction formulae of Example 1 are shown as formulae (2) and (3) as an example.

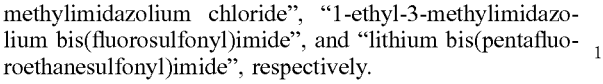

$$AlCl_3.6H_2O+3HTFSI \rightarrow Al(TFSI)_3+3HCl+6H_2O \quad (2)$$

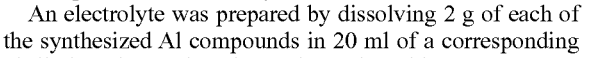

$$AlCl_3.6H_2O+3HTFSI \rightarrow Al(TFSI)_3.6(H_2O)+3HCl \quad (3)$$

As to ionic liquids used in Comparative Examples 2 to 4 in Table 1, EMIC, EMIFSI, and LiBETI mean "1-ethyl-3-methylimidazolium chloride", "1-ethyl-3-methylimidazolium bis(fluorosulfonyl)imide", and "lithium bis(pentafluoroethanesulfonyl)imide", respectively.

<Preparation of Electrolyte>

An electrolyte was prepared by dissolving 2 g of each of the synthesized Al compounds in 20 ml of a corresponding nitrile-based organic solvent shown in Table 1.

<Dehydration of Water Molecules>

A predetermined amount of each ligand shown in Table 1 was added dropwise to the electrolyte and the electrolyte was kept for two days or longer while being heated and stirred at a temperature (dehydration temperature) shown in Table 1 using a hot stirrer to dehydrate water molecules.

<Electrodeposition of Al>

Constant potential electrolysis and constant current electrolysis were conducted under electrodeposition conditions shown in Table 1 using a Cu plate as the cathode and glassy carbon as the anode. The cathode was washed with water and dried after the electrolysis, and Al was allowed to be electrodeposited on the cathode.

The following evaluations were conducted on the electrodeposit obtained on the cathode in each of the Examples and Comparative Examples. Electrodeposition conditions and evaluation results are shown in Table 1.

TABLE 1

| | | tonic Liquid | Halogenated Aluminum Compound | Organic Solvent | Ligand | Dehydration Temperature | Electrode Potential V vs. Al/Al(III) | Current Density μmA/cm$^2$ | Electrodeposition Temperature ° C. | Appearance | SEM-EDS | XRD | Electrodeposition Efficiency | Total Evaluation |
|---|---|---|---|---|---|---|---|---|---|---|---|---|---|---|
| Examples | 1 | HTFSI | $AlCl_3 \cdot 6H_2O$ | Acetonitrile | Tributyl Phosphate | 50 | −0.7 | — | 50 | Excellent | Excellent | Excellent | Good | Excellent |
| | 2 | KTFSI | $AlCl_3 \cdot 6H_2O$ | Acetonitrile | Tributyl Phosphate | 50 | −0.7 | — | 50 | Excellent | Excellent | Excellent | Good | Excellent |
| | 3 | LiTFSI | $AlCl_3 \cdot 6H_2O$ | Acetonitrile | Tributyl Phosphate | 50 | −0.7 | — | 50 | Excellent | Excellent | Excellent | Good | Excellent |
| | 4 | NaTFSI | $AlCl_3 \cdot 6H_2O$ | Acetonitrile | Tributyl Phosphate | 50 | −0.7 | — | 50 | Excellent | Excellent | Excellent | Good | Excellent |
| | 5 | HTFSI | $AlF_3 \cdot 6H_2O$ | Acetonitrile | Tributyl Phosphate | 50 | −0.7 | — | 50 | Good | Good | Good | Good | Good |
| | 6 | HTFSI | $AlBr_3 \cdot 6H_2O$ | Acetonitrile | Tributyl Phosphate | 50 | −0.7 | — | 50 | Good | Good | Good | Good | Good |
| | 7 | HTFSI | $AlI_3 \cdot 6H_2O$ | Acetonitrile | Tributyl Phosphate | 50 | −0.7 | — | 50 | Fair | Good | Good | Good | Good |
| | 8 | HTFSI | $AlCl_3 \cdot 6H_2O$ | Acetonitrile | Tributyl Phosphate | 50 | −0.7 | — | 50 | Good | Good | Good | Good | Good |
| | 9 | HTFSI | $AlCl_3 \cdot 6H_2O$ | Benzonitrile | Tributyl Phosphate | 50 | −0.7 | — | 50 | Good | Good | Good | Good | Good |
| | 10 | HTFSI | $AlCl_3 \cdot 6H_2O$ | Acetonitrile | Tributyl Phosphate | 50 | −6 | — | 50 | Fair | Good | Fair | Good | Fair |
| | 11 | HTFSI | $AlCl_3 \cdot 6H_2O$ | Acetonitrile | Tributyl Phosphate | 50 | −4 | — | 50 | Fair | Good | Good | Good | Good |
| | 12 | HTFSI | $AlCl_3 \cdot 6H_2O$ | Acetonitrile | Tributyl Phosphate | 50 | −2 | — | 50 | Good | Good | Excellent | Good | Very Good |
| | 13 | HTFSI | $AlCl_3 \cdot 6H_2O$ | Acetonitrile | Tributyl Phosphate | 50 | −0.4 | — | 50 | Fair | Good | Good | Good | Good |
| | 14 | HTFSI | $AlCl_3 \cdot 6H_2O$ | Acetonitrile | Tributyl Phosphate | 50 | — | 1 | 50 | Fair | Good | Fair | Good | Fair |
| | 15 | HTFSI | $AlCl_3 \cdot 6H_2O$ | Acetonitrile | Tributyl Phosphate | 50 | — | 10 | 50 | Fair | Good | Good | Good | Good |
| | 16 | HTFSI | $AlCl_3 \cdot 6H_2O$ | Acetonitrile | Tributyl Phosphate | 50 | — | 30 | 50 | Good | Good | Good | Good | Good |
| | 17 | HTFSI | $AlCl_3 \cdot 6H_2O$ | Acetonitrile | Tributyl Phosphate | 50 | — | 50 | 50 | Excellent | Good | Excellent | Good | Very Good |
| | 18 | HTFSI | $AlCl_3 \cdot 6H_2O$ | Acetonitrile | Tributyl Phosphate | 50 | — | 100 | 50 | Excellent | Good | Excellent | Good | Very Good |
| | 19 | HTFSI | $AlCl_3 \cdot 6H_2O$ | Acetonitrile | Tributyl Phosphate | 50 | — | 300 | 50 | Excellent | Good | Excellent | Good | Very Good |
| | 20 | HTFSI | $AlCl_3 \cdot 6H_2O$ | Acetonitrile | Tributyl Phosphate | 50 | — | 500 | 50 | Good | Good | Good | Good | Good |
| | 21 | HTFSI | $AlCl_3 \cdot 6H_2O$ | Acetonitrile | Tributyl Phosphate | 50 | — | 1000 | 50 | Fair | Good | Good | Good | Good |
| | 22 | HTFSI | $AlCl_3 \cdot 6H_2O$ | Acetonitrile | Tributyl Phosphate | 50 | — | 10000 | 50 | Fair | Fair | Fair | Good | Fair |
| | 23 | HTFSI | $AlCl_3 \cdot 6H_2O$ | Acetonitrile | Tributyl Phosphate | 50 | −0.7 | — | 20 | Good | Good | Good | Good | Good |
| | 24 | HTFSI | $AlCl_3 \cdot 6H_2O$ | Acetonitrile | Tributyl Phosphate | 50 | −0.7 | — | 30 | Excellent | Good | Good | Good | Very Good |
| | 25 | HTFSI | $AlCl_3 \cdot 6H_2O$ | Acetonitrile | Tributyl Phosphate | 50 | −0.7 | — | 70 | Excellent | Good | Good | Good | Very Good |
| | 26 | HTFSI | $AlCl_3 \cdot 6H_2O$ | Acetonitrile | Tributyl Phosphate | 50 | −0.7 | — | 80 | Good | Good | Good | Good | Good |
| | 27 | HTFSI | $AlCl_3 \cdot 6H_2O$ | Acetonitrile | Tributyl Phosphate | 50 | −0.7 | — | 100 | Fair | Fair | Fair | Good | Fair |
| | 28 | HTFSI | $AlCl_3 \cdot 6H_2O$ | Acetonitrile | Phosphonic Acid | 50 | −0.7 | — | 50 | Excellent | Good | Excellent | Good | Very Good |
| | 29 | HTFSI | $AlCl_3 \cdot 6H_2O$ | Acetonitrile | Phosphonic Acid | 50 | −0.7 | — | 50 | Excellent | Excellent | Excellent | Good | Excellent |
| | 30 | HTFSI | $AlCl_3 \cdot 6H_2O$ | Acetonitrile | Phosphonic Oxide | 50 | −0.7 | — | 50 | Excellent | Excellent | Excellent | Good | Excellent |
| | 31 | HTFSI | $AlCl_3 \cdot 6H_2O$ | Acetonitrile | N-phenyl Acetamide | 50 | −0.7 | — | 50 | Excellent | Good | Excellent | Good | Very Good |
| | 32 | HTFSI | $AlCl_3 \cdot 6H_2O$ | Acetonitrile | Dimethylformamide | 50 | −0.7 | — | 50 | Excellent | Excellent | Excellent | Good | Excellent |

TABLE 1-continued

| | | tonic Liquid | Halogenated Aluminum Compound | Organic Solvent | Ligand | Dehydration Temperature | Electrode Potential V vs. Al/Al(III) | Current Density μmA/cm$^2$ | Electrodeposition Temperature ° C. | Appearance | SEM-EDS | XRD | Electrodeposition Efficiency | Total Evaluation |
|---|---|---|---|---|---|---|---|---|---|---|---|---|---|---|
| | 33 | HTFSI | $AlCl_3 \cdot 6H_2O$ | Acetonitrile | Dimethylacetamide | 50 | −0.7 | — | 50 | Excellent | Excellent | Excellent | Good | Excellent |
| | 34 | HTFSI | $AlCl_3 \cdot 6H_{3O}$ | Acetonitrile | Tributyl Phosphate | 0 | −0.7 | — | 50 | Fair | Excellent | Excellent | Good | Good |
| | 35 | HTFSI | $AlCl_3 \cdot 6H_{3O}$ | Acetonitrile | Tributyl Phosphate | 20 | −0.7 | — | 50 | Good | Excellent | Excellent | Good | Very Good |
| | 36 | HTFSI | $AlCl_3 \cdot 6H_{4O}$ | Acetonitrile | Tributyl Phosphate | 30 | −0.7 | — | 50 | Excellent | Excellent | Excellent | Good | Excellent |
| | 37 | HTFSI | $AlCl_3 \cdot 6H_{5O}$ | Acetonitrile | Tributyl Phosphate | 70 | −0.7 | — | 50 | Excellent | Excellent | Excellent | Good | Excellent |
| | 38 | HTFSI | $AlCl_3 \cdot 6H_{6O}$ | Acetonitrile | Tributyl Phosphate | 80 | −0.7 | — | 50 | Good | Excellent | Excellent | Good | Very Good |
| | 39 | HTFSI | $AlCl_3 \cdot 6H_{7O}$ | Acetonitrile | Tributyl Phosphate | 90 | −0.7 | — | 50 | Good | Excellent | Excellent | Good | Very Good |
| | 40 | HTFSI | $AlCl_3 \cdot 6H_{3O}$ | Acetonitrile | Tributyl Phosphate | 100 | −0.7 | — | 50 | Fair | Excellent | Excellent | Good | Good |
| Comparative Examples | 1 | HTFSI | $AlCl_3 \cdot 6H_2O$ | Acetonitrile | — | 50 | −0.7 | — | 50 | Good | Good | Good | Poor | Poor |
| | 2 | EMIC | $AlCl_3 \cdot 6H_2O$ | Acetonitrile | Tributyl Phosphate | 50 | −0.7 | — | 50 | Poor | Poor | Poor | Poor | Poor |
| | 3 | EMIFSI | $AlCl_3 \cdot 6H_2O$ | Acetonitrile | Tributyl Phosphate | 50 | −0.7 | — | 50 | Poor | Poor | Poor | Poor | Poor |
| | 4 | LiBETI | $AlCl_3 \cdot 6H_2O$ | Acetonitrile | Tributyl Phosphate | 50 | −0.7 | — | 50 | Poor | Poor | Poor | Poor | Poor |
| | 5 | HTFSI | $Al_2O_3$ | Acetonitrile | Tributyl Phosphate | 50 | −0.7 | — | 50 | Poor | Poor | Poor | Poor | Poor |
| | 6 | HTFSI | $AlCl_3 \cdot 6H_2O$ | Ethanol | Tributyl Phosphate | 50 | −0.7 | — | 50 | Poor | Poor | Poor | Poor | Poor |
| | 7 | HTFSI | $AlCl_3 \cdot 6H_2O$ | Acetone | Tributyl Phosphate | 50 | −0.7 | — | 50 | Poor | Poor | Poor | Poor | Poor |
| | 8 | HTFSI | $AlCl_3 \cdot 6H_2O$ | Acetonitrile | Pyridine | 50 | −0.7 | — | 50 | Poor | Poor | Poor | Poor | Poor |

<Appearance Observation>

Electrodeposit on the cathode was visually confirmed, and a case where Al was uniformly electrodeposited without electrodeposition unevenness was rated "excellent", a case where electrodeposit could be visually confirmed while electrodeposition unevenness was observed was rated "good", a case where current or voltage could be confirmed at the time of electrolysis while electrodeposit could not visually observed was rated "fair", and a case where neither current nor voltage was confirmed at the time of electrolysis and electrodeposition of Al could not be carried out was rated "poor". That is, when the evaluation results were "fair" or better, electrodeposition of Al was evaluated as being enabled.

<SEM-EDS>

In order to analyze the obtained electrodeposit in more detail, by using a scanning electron microscope (SEM) (manufactured by JEOL Ltd., trade name: JSM-6010PLUS) and an energy dispersive X-ray spectrometer (EDS) built in the SEM, SEM-EDS analyses were conducted. A case where Al was remarkably detected was rated "excellent", a case where Al was detected was rated "good", a case where Al was slightly detected was rated "fair", and a case where Al was not detected was rated "poor".

<XRD>

In order to analyze the obtained electrodeposit in more detail, by using an X-ray diffractometer (manufactured by BRUKER, trade name: D2 PHASER), X-ray diffraction (XRD) was conducted. A case where strong peaks of Al were confirmed was rated "excellent", a case where peaks of Al were confirmed was rated "good", a case where weak peaks of Al were confirmed was rated "fair", and a case where peaks of Al were not confirmed was rated "poor".

<Electrodeposition Efficiency>

A weight (an amount collected) of the obtained electrodeposit was measured, and electrodeposition efficiency (collection rate) was calculated from the percentage of the amount collected with respect to a theoretical yield. The theoretical yield was calculated by the following equation (4) on the basis of Faraday's law. A case where the collection rate was 50% or more was rated "good" as having high electrodeposition efficiency, and a case where the collection rate was less than 50% was rated "poor" as having low electrodeposition efficiency.

$$\text{Theoretical yield} = (\text{current density} \times \text{film forming area} \times \text{film forming period} \times \text{atomic weight of Al}) / (\text{valence of Al ion} \times \text{Faraday constant}) \quad (4)$$

Atomic weight of Al=26.98,

Valence of ion=3,

Faraday constant=96500 [$C \cdot mol^{-1}$]

<Total Evaluation>

A case where electrodeposition efficiency was "good", and all items among of the other three items of appearance observation, SEM-EDS, and XRD were "excellent" was rated "excellent", a case where one or two evaluation items were "excellent" and the rest of the items were "good" was rated "very good", a case where one evaluation item was "fair" and the rest of the items were "good" or "excellent", or a case where all items were "good" was rated "good", a case where two or more evaluation item were "fair" and the rest of the items were "good" or "fair" was rated "fair", and a case where one or more evaluation items were "poor" was rated "poor".

In Examples 1 to 40, since the ionic liquids, halogenated aluminum compounds, and organic solvents were within the range defined in the present disclosure, Al could be produced through electrodeposition. That is, in Examples 1 to 40, aluminum could be electrodeposited from the halogenated aluminum hydrate instead of anhydrous halogenated aluminum, which is an undesirable raw material from a point of view of production costs, energy consumption, etc., by the ionic liquid method respectively. As a result, aluminum could be produced with lower energy consumption and at a lower cost than before. In addition, in any of Examples 1 to 40, the collection rate of aluminum as electrodeposit was high, and aluminum could be efficiently electrodeposited. Further, in Examples 1 to 4, 12, 17 to 19, 24, 25, 28 to 33, and 35 to 39, as the total evaluations were "very good" or higher, aluminum could be electrodeposited more efficiently as a whole, and especially in Examples 1 to 4, 29, 30, 32, 33, 36, and 37 with the total evaluations being "excellent", aluminum could be electrodeposited still more efficiently.

On the other hand, since ligands were not used in Comparative Example 1, while electrodeposition of Al could be confirmed, electrodeposition efficiency was inferior to those in Examples. Since the ionic liquids were not appropriate in Comparative Examples 2 to 4, no halogenated aluminum hydrate was used in Comparative Example 5, the organic solvents were not appropriate in Comparative Examples 6 and 7, and the ligands were not appropriate in Comparative Example 8, desired electrolytes could not be prepared. As a result, electrodeposition of Al could not be carried out and Al was not produced.

What is claimed is:

1. A production method of aluminum comprising:

a step of synthesizing an aluminum compound derived from an aluminum perfluoroalkyl sulfonyl imide or an aluminum perfluoroalkyl sulfonyl amide from a mixture including a halogenated aluminum hydrate and a perfluoroalkylsulfonimide-type or perfluoroalkylsulfonamide-type ionic liquid represented by following general formula (1):

wherein $Rf^1$ and $Rf^2$ are each independently $CF_3$ or $C_4F_9$, and

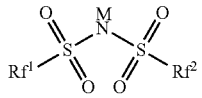

(1)

M is H, alkali metal, quaternary ammonium or imidazolium;

a step of dissolving the aluminum compound in a nitrile-based organic solvent to prepare an aluminum electrolyte;

a step of adding at least one ligand selected from either a phosphorus compound or an organic compound having an amide group to the aluminum electrolyte wherein the at least one ligand dehydrates water molecules from a hydrate included in the aluminum electrolyte; and a step of electrodepositing aluminum on a cathode by allowing electricity to pass between an anode and the cathode in the aluminum electrolyte after the adding step.

2. The production method of aluminum according to claim 1, wherein the aluminum electrolyte with the at least one ligand added is stirred at 0° C. or higher and 100° C. or lower in the adding step.

3. The production method of aluminum according to claim 1, wherein constant potential electrolysis with an electrode potential with respect to aluminum used as a reference electrode of −6.0 V or more and less than 0 V or constant current electrolysis with a current density of 1 $\mu Acm^{-2}$ or more and 10000 $\mu Acm^{-2}$ or less is carried out in the electrodepositing step.

4. The production method of aluminum according to claim 1, wherein a temperature of an electrolytic bath is 20° C. or higher and 100° C. or lower in the electrodepositing step.

5. The production method of aluminum according to claim 1, wherein $Rf^1$ and $Rf^2$ in the general formula (1) are $CF_3$.

6. The production method of aluminum according to claim 1, wherein the halogenated aluminum hydrate is aluminum (III) chloride hexahydrate.

7. The production method of aluminum according to claim 1, wherein the phosphorus compound is selected from the group consisting of phosphinic acid, a phosphine oxide, and tributyl phosphate.

8. The production method of aluminum according to claim 1, wherein the organic compound having an amide group is selected from the group consisting of N-phenylacetamide, dimethylformamide, and dimethylacetamide.

* * * * *